US010553230B2

(12) United States Patent
Hatanaka et al.

(10) Patent No.: US 10,553,230 B2
(45) Date of Patent: Feb. 4, 2020

(54) DECODING APPARATUS, DECODING METHOD, AND PROGRAM

(71) Applicant: Sony Corporation, Tokyo (JP)

(72) Inventors: Mitsuyuki Hatanaka, Kanagawa (JP); Toru Chinen, Kanagawa (JP); Minoru Tsuji, Chiba (JP); Hiroyuki Honma, Chiba (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 15/772,310

(22) PCT Filed: Oct. 26, 2016

(86) PCT No.: PCT/JP2016/081699
§ 371 (c)(1),
(2) Date: Apr. 30, 2018

(87) PCT Pub. No.: WO2017/082050
PCT Pub. Date: May 18, 2017

(65) Prior Publication Data

US 2018/0286419 A1 Oct. 4, 2018

(30) Foreign Application Priority Data

Nov. 9, 2015 (JP) ..... 2015-219415

(51) Int. Cl.
*G10L 19/00* (2013.01)
*G10L 19/12* (2013.01)
*G10L 19/032* (2013.01)

(52) U.S. Cl.
CPC ..... *G10L 19/12* (2013.01); *G10L 19/032* (2013.01)

(58) Field of Classification Search
CPC ..... G10L 19/00
(Continued)

(56) References Cited

U.S. PATENT DOCUMENTS 5,867,819 A 2/1999 Fukuchi et al.
6,944,510 B1 * 9/2005 Ballesty ..... G10L 21/04 381/119
(Continued)

FOREIGN PATENT DOCUMENTS

JP 09-252254 A 9/1997
JP 2002-026738 A 1/2002

OTHER PUBLICATIONS

International Search Report and English translation thereof dated Jan. 10, 2017 in connection with International Application No. PCT/JP2016/081699.
(Continued)

*Primary Examiner* — Michael C Colucci
(74) *Attorney, Agent, or Firm* — Wolf, Greenfield & Sacks, P.C.

(57) ABSTRACT

The present disclosure relates to a decoding apparatus, a decoding method, and a program that can switch, as quickly as possible, a plurality of audio encoded bit streams with synchronized reproduction timing to thereby decode and output the plurality of audio encoded bit streams.

An aspect of the present disclosure provides a decoding apparatus including: an acquisition unit that acquires a plurality of audio encoded bit streams; a selection unit that determines a boundary position for switching output of the plurality of audio encoded bit streams and that selectively supplies one of the plurality of acquired audio encoded bit streams to a decoding processing unit according to the boundary position; and the decoding processing unit that applies a decoding process including IMDCT processing to the one input through the selection unit, in which the decoding processing unit skips overlap-and-add in the IMDCT processing corresponding to each frame before and
(Continued)

after the boundary position. The present disclosure can be applied to, for example, a reception apparatus, a reproduction apparatus, and the like.

15 Claims, 13 Drawing Sheets

(58) Field of Classification Search
USPC ..... 704/500, 503, 278, 258, 229, 207; 714/776; 386/343; 381/119; 375/240.25, 150
See application file for complete search history.

(56) References Cited

U.S. PATENT DOCUMENTS 7,047,194 B1* 5/2006 Buskies ..... G10L 13/07 704/258
7,113,538 B1* 9/2006 Chen ..... H04B 1/70752 375/150
8,189,114 B2* 5/2012 Petersohn ..... G06K 9/00765 348/135
2002/0133764 A1* 9/2002 Wang ..... G10H 1/0058 714/707
2004/0196988 A1* 10/2004 Moulios ..... G10H 1/0091 381/119
2004/0257939 A1* 12/2004 Kawamura ..... H04N 5/76 369/47.23
2005/0149973 A1 7/2005 Fang
2006/0184861 A1* 8/2006 Sun ..... G10L 19/005 714/776
2007/0033057 A1* 2/2007 Covell ..... G10L 21/04 704/503
2007/0225971 A1* 9/2007 Bessette ..... G10L 19/0208 704/203
2008/0033585 A1* 2/2008 Zopf ..... G10L 19/005 700/94
2008/0033718 A1* 2/2008 Zopf ..... G10L 19/005 704/229
2008/0065373 A1 3/2008 Oshikiri
2010/0070270 A1* 3/2010 Gao ..... G10H 1/0041 704/207
2010/0268530 A1* 10/2010 Sun ..... G10L 25/90 704/207
2011/0216836 A1* 9/2011 Luo ..... H04N 19/00 375/240.25
2011/0224990 A1* 9/2011 Hosokawa ..... G10L 21/04 704/278
2015/0073812 A1* 3/2015 Lowe ..... G06Q 30/02 704/500
2015/0279382 A1* 10/2015 Atti ..... G10L 19/02 704/500
2016/0055864 A1* 2/2016 Purnhagen ..... G10L 21/055 725/131
2016/0071524 A1* 3/2016 Tammi ..... H04N 5/77 386/343
2019/0026934 A1* 1/2019 Shih ..... G06T 15/005

OTHER PUBLICATIONS

Written Opinion and English translation thereof dated Jan. 10, 2017 in connection with International Application No. PCT/JP2016/081699.
International Preliminary Report on Patentability and English translation thereof dated May 24, 2018 in connection with International Application No. PCT/JP2016/081699.
Extended European Search Report dated Jul. 20, 2018 in connection with European Application No. 16864014.2.

* cited by examiner

DECODING APPARATUS, DECODING METHOD, AND PROGRAM

CROSS-REFERENCE TO RELATED APPLICATIONS

This application claims the benefit under 35 U.S.C. § 371 as a U.S. National Stage Entry of International Application No. PCT/JP2016/081699, filed in the Japanese Patent Office as a Receiving Office on Oct. 26, 2016, which claims priority to Japanese Patent Application Number JP2015-219415, filed in the Japanese Patent Office on Nov. 9, 2015, each of which is hereby incorporated by reference in its entirety.

TECHNICAL FIELD

The present disclosure relates to a decoding apparatus, a decoding method, and a program, and particularly, to a decoding apparatus, a decoding method, and a program suitable for use in switching output between audio encoded bit streams in which reproduction timing is synchronized.

BACKGROUND ART

For example, sounds of a plurality of languages (for example, Japanese and English) are prepared in some videos for content of movies, news, live sports, and the like, and in this case, the reproduction timing of the plurality of sounds is synchronized.

Hereinafter, it is assumed that the sounds with synchronized reproduction timing are each prepared as audio encoded bit streams, and an encoding process, such as AAC (Advanced Audio Coding) including at least MDCT (Modified Discrete Cosine Transform) processing, is executed to apply variable-length coding to the audio encoded bit streams. Note that an MPEG-2 AAC sound encoding system including the MDCT processing is adopted in digital terrestrial television broadcasting (for example, see NPL 1).

FIG. 1 simply illustrates an example of a conventional configuration of an encoding apparatus that applies an encoding process to source data of sound and a decoding apparatus that applies a decoding process to an audio encoded bit stream output from the encoding apparatus.

An encoding apparatus 10 includes an MDCT unit 11, a quantization unit 12, and a variable-length coding unit 13.

The MDCT unit 11 divides source data of sound input from an earlier stage into frames with a predetermined time width and executes MDCT processing such that the previous and next frames overlap with each other. In this way, the MDCT unit 11 converts the source data with values of time domain into values of frequency domain and outputs the values to the quantization unit 12. The quantization unit 12 quantizes the input from the MDCT unit 11 and outputs the values to the variable-length coding unit 13. The variable-length coding unit 13 applies variable-length coding to the quantized values to generate and output an audio encoded bit stream.

A decoding apparatus 20 is mounted on, for example, a reception apparatus that receives broadcasted or distributed content or on a reproduction apparatus that reproduces content recorded in a recording medium, and the decoding apparatus 20 includes a decoding unit 21, an inverse quantization unit 22, and an IMDCT (Inverse MDCT) unit 23.

The decoding unit 21 corresponding to the variable-length coding unit 13 applies a decoding process to the audio encoded bit stream on the basis of frames and outputs a decoding result to the inverse quantization unit 22. The inverse quantization unit 22 corresponding to the quantization unit 12 applies inverse quantization to the decoding result and outputs a processing result to the IMDCT unit 23. The IMDCT unit 23 corresponding to the MDCT unit 11 applies IMDCT processing to the inverse quantization result to reconstruct PCM data corresponding to the source data before encoding. The IMDCT processing by the IMDCT unit 23 will be described in detail.

FIG. 2 illustrates the IMDCT processing by the IMDCT unit 23.

As depicted in FIG. 2, the IMDCT unit 23 applies the IMDCT processing to audio encoded bit streams (inverse quantization results of the audio encoded bit streams) BS1-1 and BS1-2 of two previous and next frames (Frame #1 and Frame #2) to obtain IMDCT-OUT #1-1 as a reverse conversion result. The IMDCT unit 23 also applies the IMDCT processing to audio encoded bit streams (inverse quantization results of the audio encoded bit streams) BS1-2 and BS1-3 of two frames (Frame #2 and Frame #3) overlapping with the audio encoded bit streams described above to obtain IMDCT-OUT #1-2 as a reverse conversion result. The IMDCT unit 23 further applies overlap-and-add to IMDCT-OUT #1-1 and IMDCT-OUT #1-2 to completely reconstruct PCM1-2 that is PCM data corresponding to Frame #2.

PCM data 1-3, . . . corresponding to Frame #3 and later frames are also completely reconstructed by a similar method.

However, the term "completely" used here denotes that the PCM data is reconstructed including the process up to the overlap-and-add, and the term does not denote that the source data is reproduced 100%.

CITATION LIST

Non Patent Literature

[NPL 1]
ARIB STD-B32, version 2.2, Jul. 29, 2015

SUMMARY

Technical Problems

Here, switching a plurality of audio encoded bit streams with synchronized reproduction timing as quickly as possible to thereby decode and output the plurality of audio encoded bit streams will be considered.

FIG. 3 illustrates a conventional method of switching a first audio encoded bit stream to a second audio encoded bit stream in which the reproduction timing is synchronized.

As depicted in FIG. 3, when a switch boundary position is set between Frame #2 and Frame #3, and the first audio encoded bit stream is to be switched to the second audio encoded bit stream, data up to PCM1-2 corresponding to Frame #2 is decoded and output for the first audio encoded bit stream. Data from PCM2-3 corresponding to Frame #3 is decoded and output for the second audio encoded bit stream after the switch.

Incidentally, the reverse conversion results IMDCT-OUT #1-1 and IMDCT-OUT #1-2 are necessary to obtain PCM1-2 as described with reference to FIG. 2. Similarly, reverse conversion results IMDCT-OUT #2-2 and IMDCT-OUT #2-3 are necessary to obtain PCM2-3. Therefore, to execute the switch illustrated in FIG. 3, the decoding process including the IMDCT processing needs to be applied to the first and second audio encoded bit streams in parallel and at the same time during the period between Frame #2 and Frame #3.

However, to execute the decoding process including the IMDCT processing in parallel and at the same time, a plurality of pieces of hardware with a similar configuration are necessary to realize the decoding process including the IMDCT processing by hardware, and this enlarges the circuit scale and increases the cost.

Further, to realize the decoding process including the IMDCT processing by software, problems, such as interruption of sound and abnormal sound, may occur depending on the throughput of the CPU. Therefore, a high-performance CPU is necessary to prevent the problems, and this increases the cost as well.

The present disclosure has been made in view of the circumstances, and the present disclosure is designed to switch, as quickly as possible, a plurality of audio encoded bit streams with synchronized reproduction timing to thereby decode and output the plurality of audio encoded bit streams without enlarging the circuit scale or increasing the cost.

Solution to Problems

An aspect of the present disclosure provides a decoding apparatus including: an acquisition unit that acquires a plurality of audio encoded bit streams in which a plurality of pieces of source data with synchronized reproduction timing are each encoded on the basis of frames after MDCT processing; a selection unit that determines a boundary position for switching output of the plurality of audio encoded bit streams and that selectively supplies one of the plurality of acquired audio encoded bit streams to a decoding processing unit according to the boundary position; and the decoding processing unit that applies a decoding process including IMDCT processing corresponding to the MDCT processing to one of the plurality of audio encoded bit streams input through the selection unit, in which the decoding processing unit skips overlap-and-add in the IMDCT processing corresponding to each frame before and after the boundary position.

The decoding apparatus according to the aspect of the present disclosure can further include a fading processing unit that applies fading processing to decoding processing results of the frames before and after the boundary position in which the overlap-and-add by the decoding processing unit is skipped.

The fading processing unit can apply a fade-out process to the decoding processing result of the frame before the boundary position and apply a fade-in process to the decoding processing result of the frame after the boundary position in which the overlap-and-add by the decoding processing unit is skipped.

The fading processing unit can apply a fade-out process to the decoding processing result of the frame before the boundary position and apply a muting process to the decoding processing result of the frame after the boundary position in which the overlap-and-add by the decoding processing unit is skipped.

The fading processing unit can apply a muting process to the decoding processing result of the frame before the boundary position and apply a fade-in process to the decoding processing result of the frame after the boundary position in which the overlap-and-add by the decoding processing unit is skipped.

The selection unit can determine the boundary position on the basis of an optimal switch position flag that is added to each frame and that is set by a supplier of the plurality of audio encoded bit streams.

The optimal switch position flag can be set by the supplier of the audio encoded bit streams on the basis of energy or context of the source data.

The selection unit can determine the boundary position on the basis of information associated with gain of the plurality of audio encoded bit streams.

An aspect of the present disclosure provides a decoding method executed by a decoding apparatus, the decoding method including: an acquisition step of acquiring a plurality of audio encoded bit streams in which a plurality of pieces of source data with synchronized reproduction timing are each encoded on the basis of frames after MDCT processing; a determination step of determining a boundary position for switching output of the plurality of audio encoded bit streams; a selection step of selectively supplying one of the plurality of acquired audio encoded bit streams to a decoding processing step according to the boundary position; and the decoding processing step of applying a decoding process including IMDCT processing corresponding to the MDCT processing to one of the plurality of audio encoded bit streams supplied selectively, in which in the decoding processing step, overlap-and-add in the IMDCT processing corresponding to each frame before and after the boundary position is skipped.

An aspect of the present disclosure provides a program causing a computer to function as: an acquisition unit that acquires a plurality of audio encoded bit streams in which a plurality of pieces of source data with synchronized reproduction timing are encoded on the basis of frames after MDCT processing; a selection unit that determines a boundary position for switching output of the plurality of audio encoded bit streams and that selectively supplies one of the plurality of acquired audio encoded bit streams to a decoding processing unit according to the boundary position; and the decoding processing unit that applies a decoding process including IMDCT processing corresponding to the MDCT processing to one of the plurality of audio encoded bit streams input through the selection unit, in which the decoding processing unit skips overlap-and-add in the IMDCT processing corresponding to each frame before and after the boundary position.

According to the aspect of the present disclosure, the plurality of audio encoded bit streams are acquired, and the boundary position for switching the output of the plurality of audio encoded bit streams is determined. The decoding process including the IMDCT processing corresponding to the MDCT processing is applied to one of the plurality of audio encoded bit streams selectively supplied according to the boundary position. In the decoding process, the overlap-and-add in the IMDCT processing corresponding to each frame before and after the boundary position is skipped.

Advantageous Effect of Invention

According to the aspect of the present disclosure, the plurality of audio encoded bit streams with synchronized reproduction timing can be switched as quickly as possible to thereby decode and output the plurality of audio encoded bit streams.

DESCRIPTION OF EMBODIMENT

Hereinafter, the best mode for carrying out the present disclosure (hereinafter, referred to as embodiment) will be described in detail with reference to the drawings.

<Configuration Example of Decoding Apparatus as Embodiment of Present Disclosure>

Figure 1:
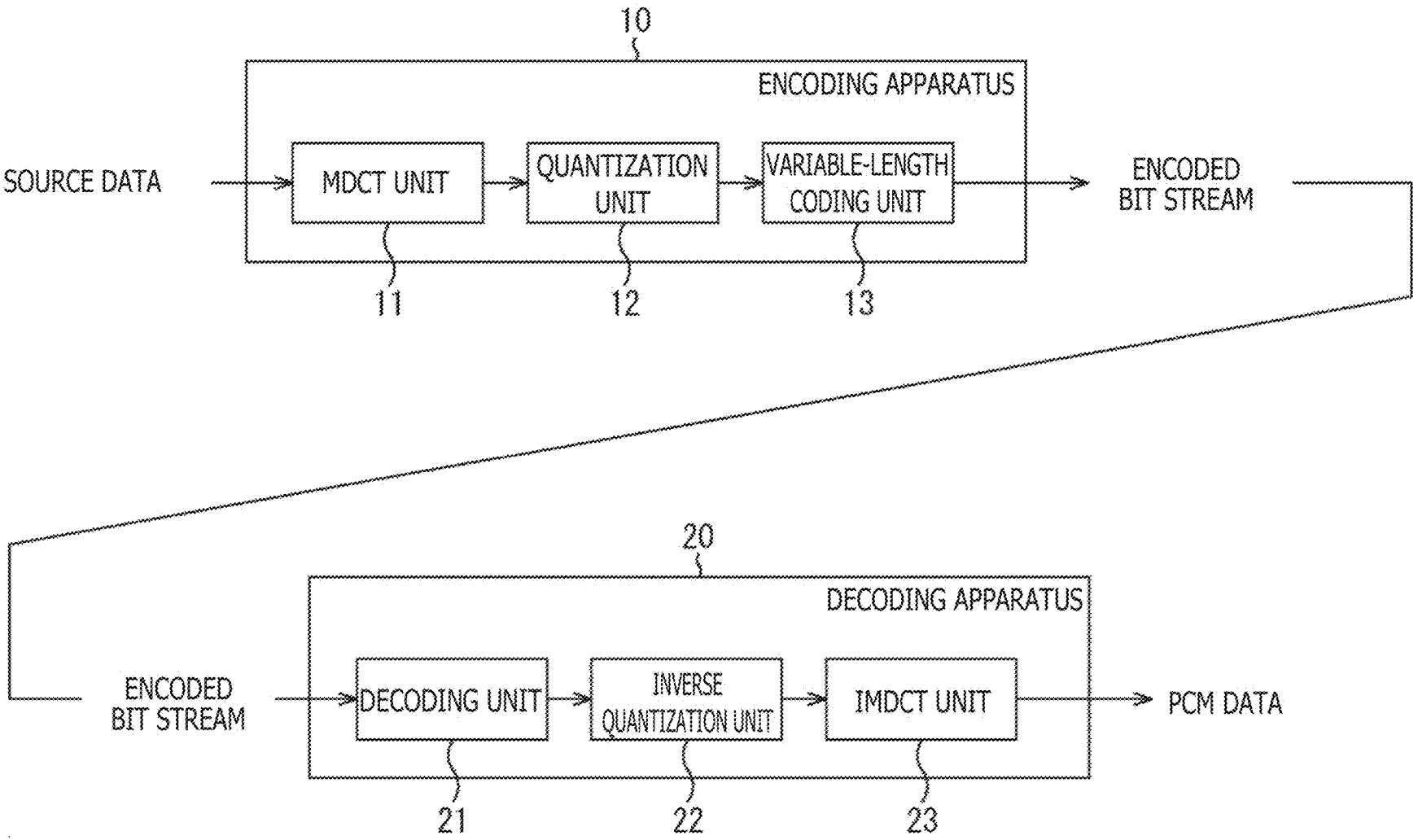
FIG. 1 is a block diagram depicting an example of configuration of an encoding apparatus and a decoding apparatus.
Figure 2:
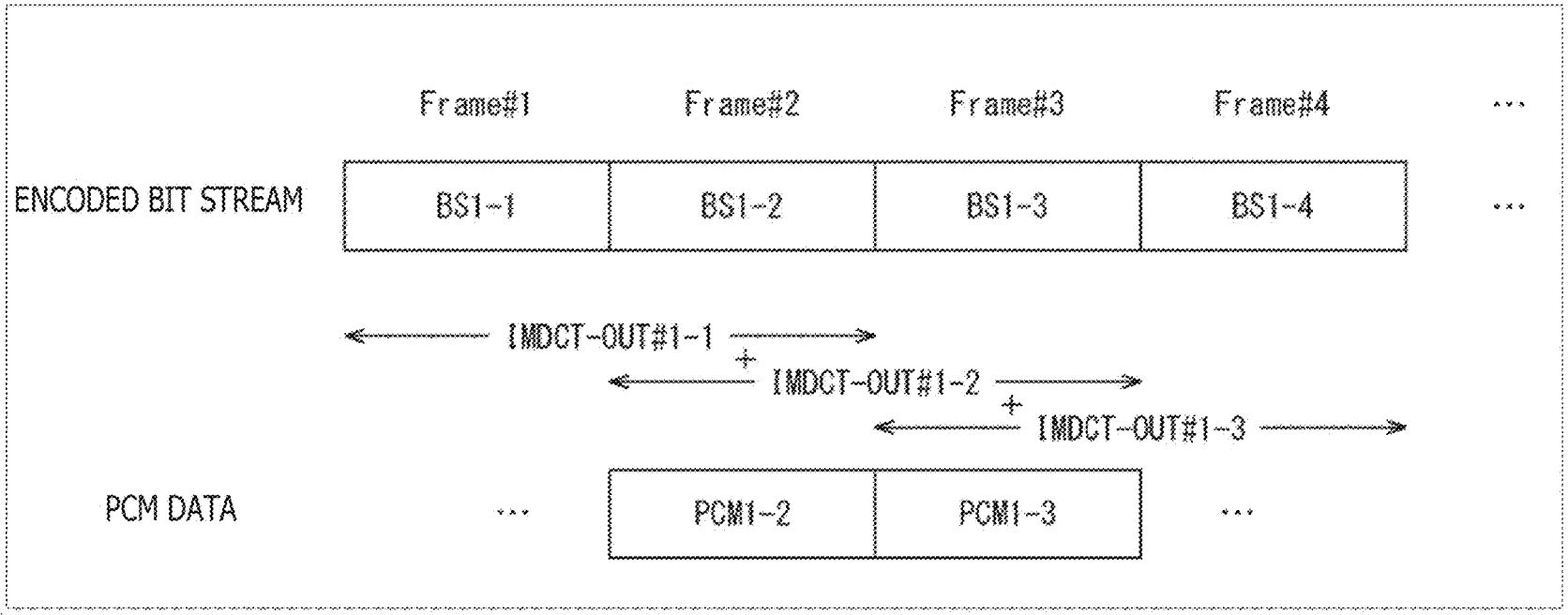
FIG. 2 is a diagram describing IMDCT processing.
Figure 3:
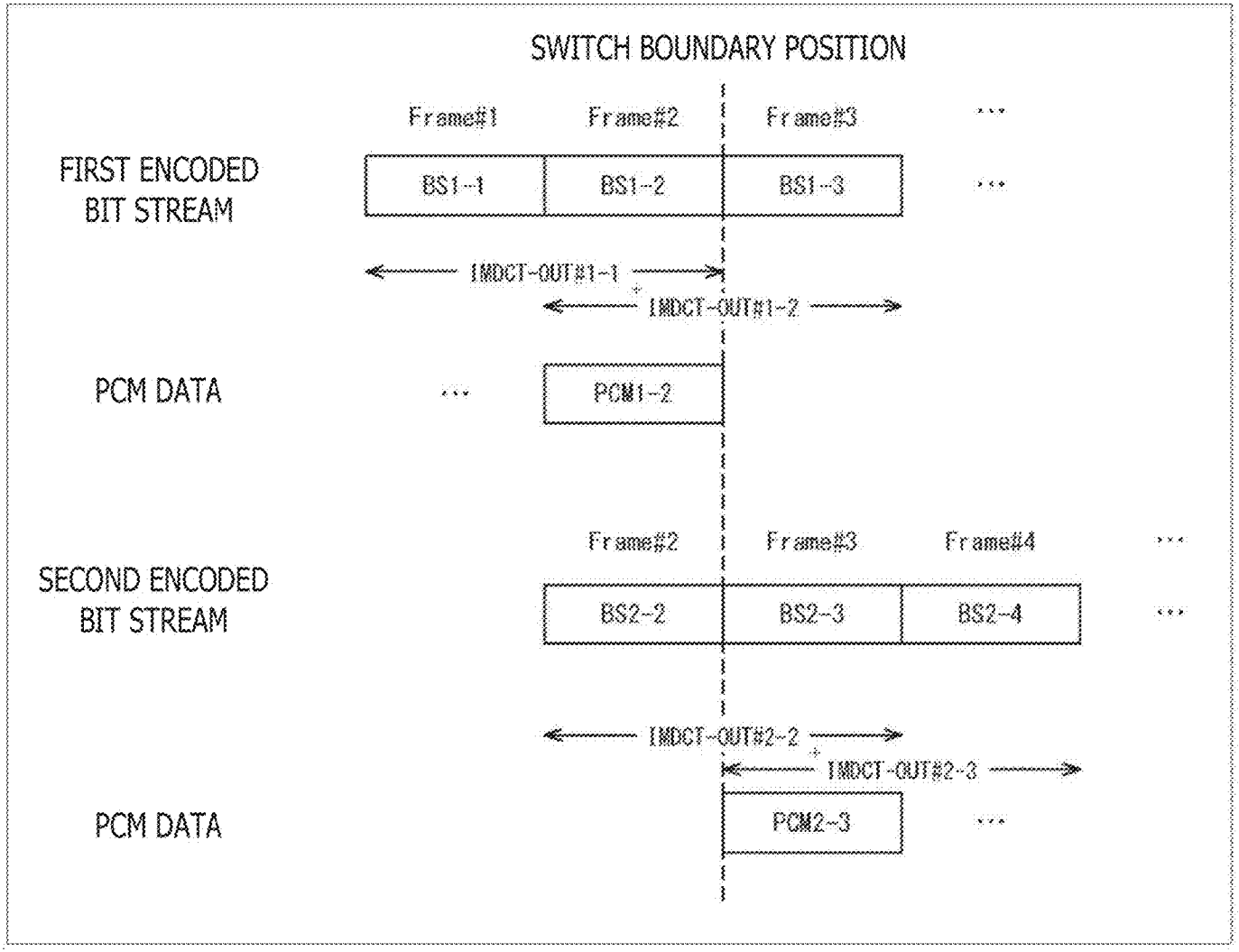
FIG. 3 is a diagram depicting switching of an audio encoded bit stream.
Figure 4:
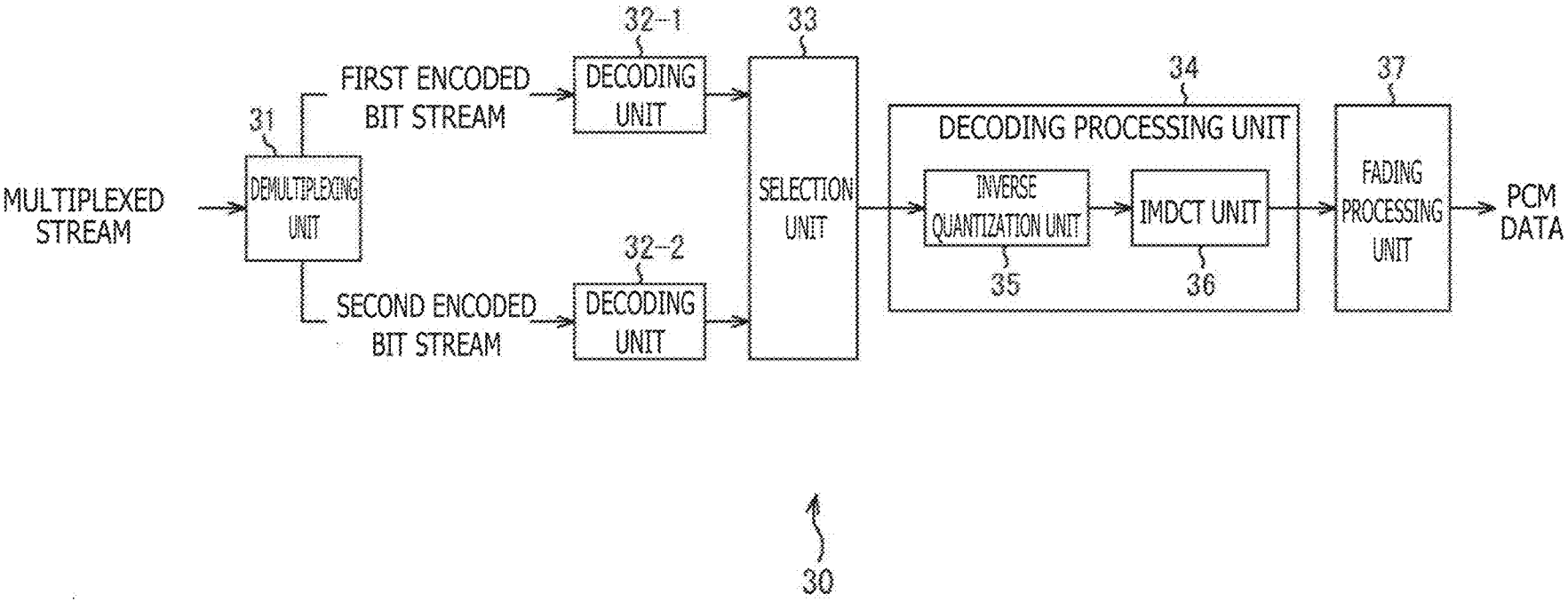
FIG. 4 is a block diagram depicting a configuration example of a decoding apparatus according to the present disclosure.

FIG. 4 depicts a configuration example of a decoding apparatus as an embodiment of the present disclosure.

A decoding apparatus 30 is mounted on, for example, a reception apparatus that receives broadcasted or distributed content or on a reproduction apparatus that reproduces content recorded in a recording medium. Further, the decoding apparatus 30 can quickly switch first and second audio encoded bit streams with synchronized reproduction timing to decode and output the bit streams.

It is assumed that an encoding process including at least MDCT processing is executed to apply variable-length coding to source data of sound in the first and second audio encoded bit streams. Hereinafter, the first and second audio encoded bit streams will also be simply referred to as first and second encoded bit streams.

The decoding apparatus 30 includes a demultiplexing unit 31, decoding units 32-1 and 32-2, a selection unit 33, a decoding processing unit 34, and a fading processing unit 37.

The demultiplexing unit 11 separates a first encoded bit stream and a second encoded stream with synchronized reproduction timing from a multiplexed stream input from an earlier stage. The multiplexing unit 11 further outputs the first encoded bit stream to the decoding unit 32-1 and outputs the second encoded stream to the decoding unit 32-2.

The decoding unit 32-1 applies a decoding process to the first encoded bit stream to decode the variable-length code of the first encoded bit stream and outputs a processing result (hereinafter, referred to as quantization data) to the selection unit 33. The decoding unit 32-2 applies a decoding process to the second encoded bit stream to decode the variable-length code of the second encoded bit stream and outputs quantization data of a processing result to the selection unit 33.

The selection unit 33 determines a switch boundary position on the basis of a sound switch instruction from a user and outputs the quantization data from the decoding unit 32-1 or the decoding unit 32-2 to the decoding processing unit 34 according to the determined switch boundary position.

The selection unit 33 can also determine the switch boundary position on the basis of an optimal switch position flag added to each frame of the first and second encoded bit streams. This will be described later with reference to FIGS. 7 to 10.

The decoding processing unit 34 includes an inverse quantization unit 35 and an IMDCT unit 36. The inverse quantization unit 35 applies inverse quantization to the quantization data input through the selection unit 33 and outputs an inverse quantization result (hereinafter, referred to as MDCT data) to the IMDCT unit 36. The IMDCT unit 36 applies IMDCT processing to the MDCT data to reconstruct PCM data corresponding to source data before encoding.

However, the IMDCT unit 36 does not completely reconstruct the PCM data corresponding to all of the respective frames, and the IMDCT unit 36 also outputs PCM data reconstructed in an incomplete state for frames near the switch boundary position.

The fading processing unit 37 applies a fade-out process, a fade-in process, or a muting process to the PCM data near the switch boundary position input from the decoding processing unit 34 and outputs the PCM data to a later stage.

Note that although the multiplexed stream with multiplexed first and second encoded bit streams is input to the decoding apparatus 30 in the case illustrated in the configuration example depicted in FIG. 4, more encoded bit streams may be multiplexed in the multiplexed stream. In this case, the number of decoding units 32 may be increased according to the number of multiplexed encoded bit streams.

Further, a plurality of encoded bit streams may be separately input to the decoding apparatus 30 instead of inputting the multiplexed stream. In this case, the demultiplexing unit 31 can be eliminated.

<First Switching Method of Encoded Bit Stream by Decoding Apparatus 30>

Figure 5:
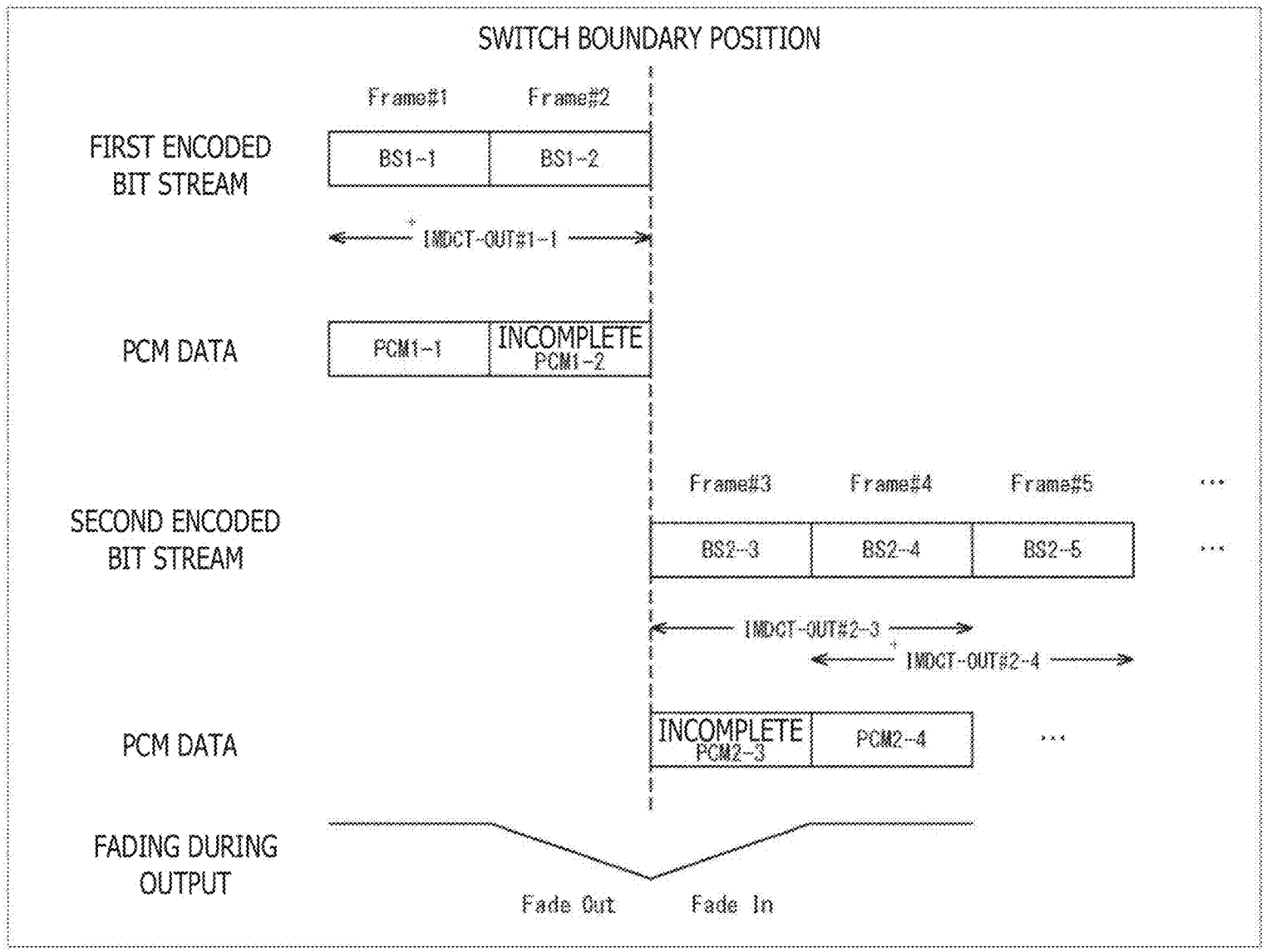
FIG. 5 is a diagram depicting a first switching method of an audio encoded bit stream by the decoding apparatus of FIG. 4.

Next, FIG. 5 depicts a first switching method of the encoded bit stream by the decoding apparatus 30.

As depicted in FIG. 5, when a switch boundary position is set between Frame #2 and Frame #3, and the first encoded bit stream is to be switched to the second encoded bit stream, the IMDCT processing is applied to the data up to Frame #2 just before the switch boundary position for the first encoded bit stream. In this case, although the data up to PCM1-1 corresponding to Frame #1 can be completely reconstructed, the reconstruction of PCM1-2 corresponding to Frame #2 is incomplete.

Meanwhile, for the second encoded bit stream, the IMDCT processing is applied to the data from Frame #3 just after the switch boundary position. In this case, the reconstruction of PCM2-3 corresponding to Frame #3 is incomplete, and the data is completely reconstructed from PCM2-4 corresponding to Frame #4.

Here, the "incomplete reconstruction" denotes that the first half or the second half of IMDCT-OUT is used as PCM data without execution of overlap-and-add.

In this case, the second half of MDCT-OUT #1-1 can be used for PCM1-2 corresponding to Frame #2 of the first encoded bit stream. Similarly, the first half of MDCT-OUT #2-3 can be used for PCM2-3 corresponding to Frame #3 of the second encoded bit stream. Note that, obviously, the sound quality of incompletely reconstructed PCM1-2 and PCM2-3 is lower than the sound quality of completely reconstructed PCM1-2 and PCM2-3.

When the PCM data is output, the data up to completely reconstructed PCM1-1 corresponding to Frame #1 is output at a normal volume. The volume of incomplete PCM1-2 corresponding to Frame #2 just before the switch boundary position is gradually reduced by the fade-out process, and the volume of incomplete PCM2-3 corresponding to Frame #3 just after the switch boundary position is gradually increased by the fade-in process. From Frame #4, completely reconstructed PCM2-4, . . . are output at a normal volume.

In this way, the incompletely reconstructed PCM data is output just after the change boundary position, and there is no need to execute two decoding processes in parallel. Furthermore, the fade-out process and the fade-in process connect the incomplete PCM data, and this can reduce the volume of harsh glitch noise caused by discontinuity of frames due to the switch of sound.

Note that the switching method of the encoded bit stream by the decoding apparatus 30 is not limited to the first switching method, and second or third switching methods described later can also be adopted.

<Sound Switching Process by Decoding Apparatus 30>

Figure 6:
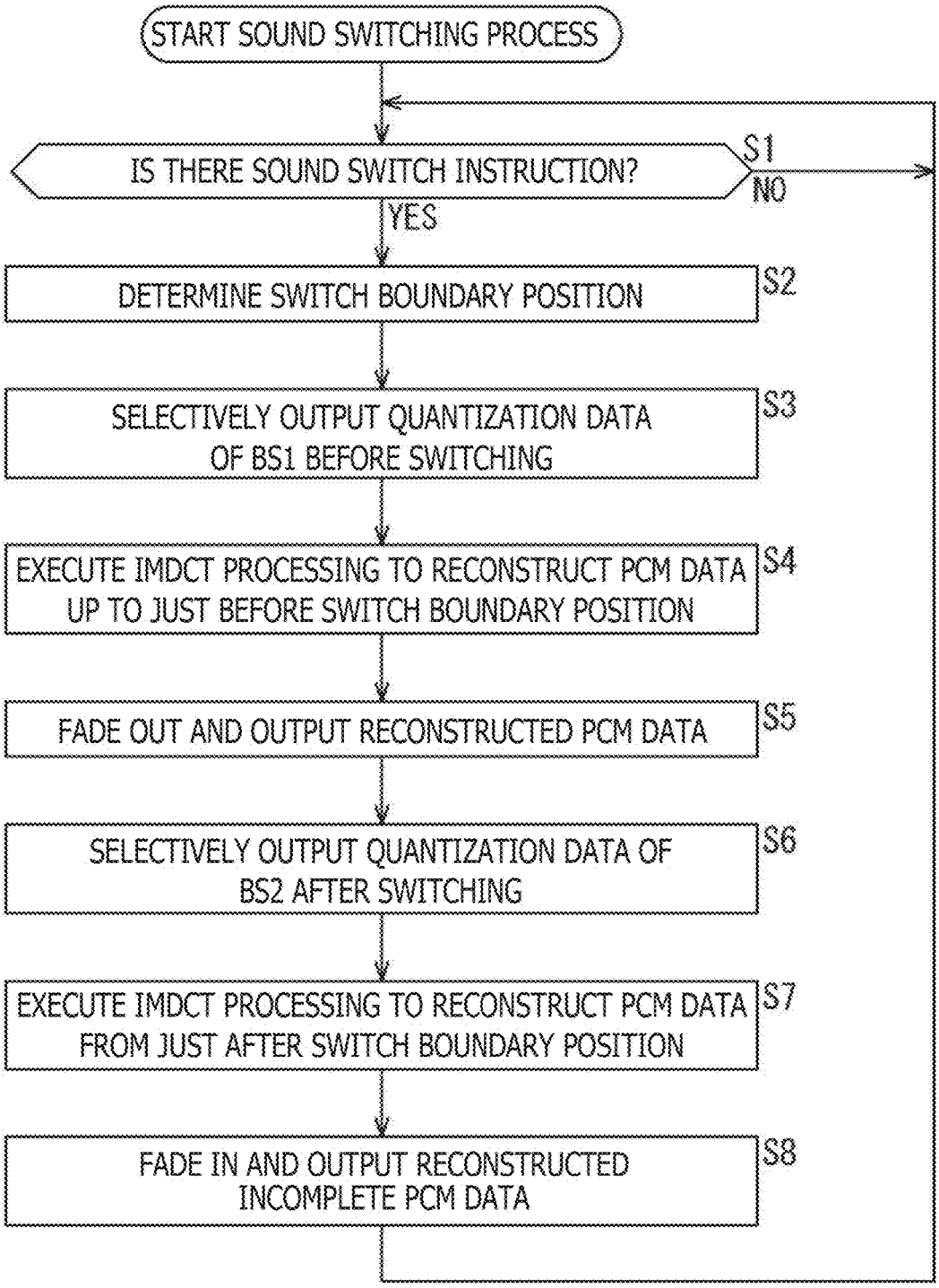
FIG. 6 is a flow chart describing a sound switching process.

Next, FIG. 6 is a flow chart describing a sound switching process corresponding to the first switching method depicted in FIG. 5.

It is assumed that before the sound switching process, the demultiplexing unit 11 has separated the first and second encoded bit streams from the multiplexed stream, and the decoding units 32-1 or 31-2 have decoded the first and second encoded bit streams, respectively, in the decoding apparatus 30. It is also assumed that the selection unit 33 has selected the quantization data from one of the decoding units 32-1 and 31-2 and input the quantization data to the decoding processing unit 34.

In a case described below, the selection unit 33 selects the quantization data from the decoding unit 32-1 and inputs the quantization data to the decoding processing unit 34. As a result, the decoding apparatus 30 is currently outputting the PCM data based on the first encoded bit stream at a normal volume.

In step S1, the selection unit 33 determines whether or not there is a sound switch instruction from the user and waits until there is a sound switch instruction. While the selection unit 33 waits, the selective output by the selection unit 33 is maintained. Therefore, the decoding apparatus 30 continuously outputs the PCM data based on the first encoded bit stream at a normal volume.

When there is a sound switch instruction from the user, the process proceeds to step S2. In step S2, the selection unit 33 determines the switch boundary position of the sound. For example, the selection unit 33 determines the switch boundary position of the sound at a position after a predetermined number of frames from the reception of the sound switch instruction. However, the selection unit 33 may determine the switch boundary position on the basis of an optimal switch position flag included in the encoded bit stream (described in detail later).

In this case, it is assumed that the switch boundary position is set between Frame #2 and Frame #3 as depicted in FIG. 5.

Subsequently, in step S3, the selection unit 33 maintains the current selection until the selection unit 33 outputs the quantization data corresponding to the frame just before the determined switch boundary position to the decoding processing unit 34. Therefore, the selection unit 33 outputs the quantization data from the decoding unit 32-1 to the later stage.

In step S4, the inverse quantization unit 35 of the decoding processing unit 34 performs inverse quantization of the quantization data based on the first encoded bit stream and outputs the MDCT data obtained as a result of the inverse quantization to the IMDCT unit 36. The IMDCT unit 36 applies IMDCT processing to the data up to the MDCT data corresponding to the frame just before the switch boundary position to thereby reconstruct the PCM data corresponding to the source data before encoding and outputs the PCM data to the fading processing unit 37.

In this case, although the data up to PCM1-1 corresponding to Frame #1 can be completely reconstructed, the reconstruction of PCM1-2 corresponding to Frame #2 is incomplete.

In step S5, the fading processing unit 37 applies the fade-out process to the incomplete PCM data corresponding to the frame (in this case, PCM1-2 corresponding to Frame #2) just before the switch boundary position input from the decoding processing unit 34 and outputs the PCM data to the later stage.

Next, in step S6, the selection unit 33 switches the output for the decoding processing unit 34. Therefore, the selection unit 33 outputs the quantization data from the decoding unit 32-2 to the later stage.

In step S7, the inverse quantization unit 35 of the decoding processing unit 34 performs inverse quantization of the quantization data based on the second encoded bit stream and outputs the MDCT data obtained as a result of the inverse quantization to the IMDCT unit 36. The IMDCT unit 36 applies IMDCT processing to the data from the MDCT data corresponding to the frame just after the switch boundary position to thereby reconstruct the PCM data corresponding to the source data before encoding and outputs the PCM data to the fading processing unit 37.

In this case, the reconstruction of PCM2-3 corresponding to Frame #3 is incomplete, and the data is completely reconstructed from PCM2-4 corresponding to Frame #4.

In step S8, the fading processing unit 37 applies the fade-in process to the incomplete PCM data corresponding to the frame (in this case, PCM2-3 corresponding to Frame #3) just after the switch boundary position input from the decoding processing unit 34 and outputs the PCM data to the later stage. The process then returns to step Si, and the subsequent process is repeated.

This completes the description of the sound switching process by the decoding apparatus 30. According to the sound switching process, the encoded bit stream of the sound can be switched without executing two decoding processes in parallel. The sound switching process can also reduce the volume of harsh glitch noise caused by discontinuity of frames due to the switch of sound.

<Optimal Switch Position Flag Setting Process>

In the sound switching process, the switch boundary position of the sound is determined at the position after the predetermined number of frames from the reception of the sound switch instruction from the user. However, in consideration of the execution of the fade-out process and the fade-in process near the switch boundary position, it is desirable that the switch boundary position be a position where the sound is as close to silence as possible or a position where a series of words or conversations are comprehensive even if the volume is temporarily reduced according to the context.

Therefore, in a process (hereinafter, optimal switch position flag setting process) described next, a supplier of the content detects a state of the sound as close to silence as possible (that is, state with a small gain or energy in source data) and sets an optimal switch position flag there.

Figure 7:
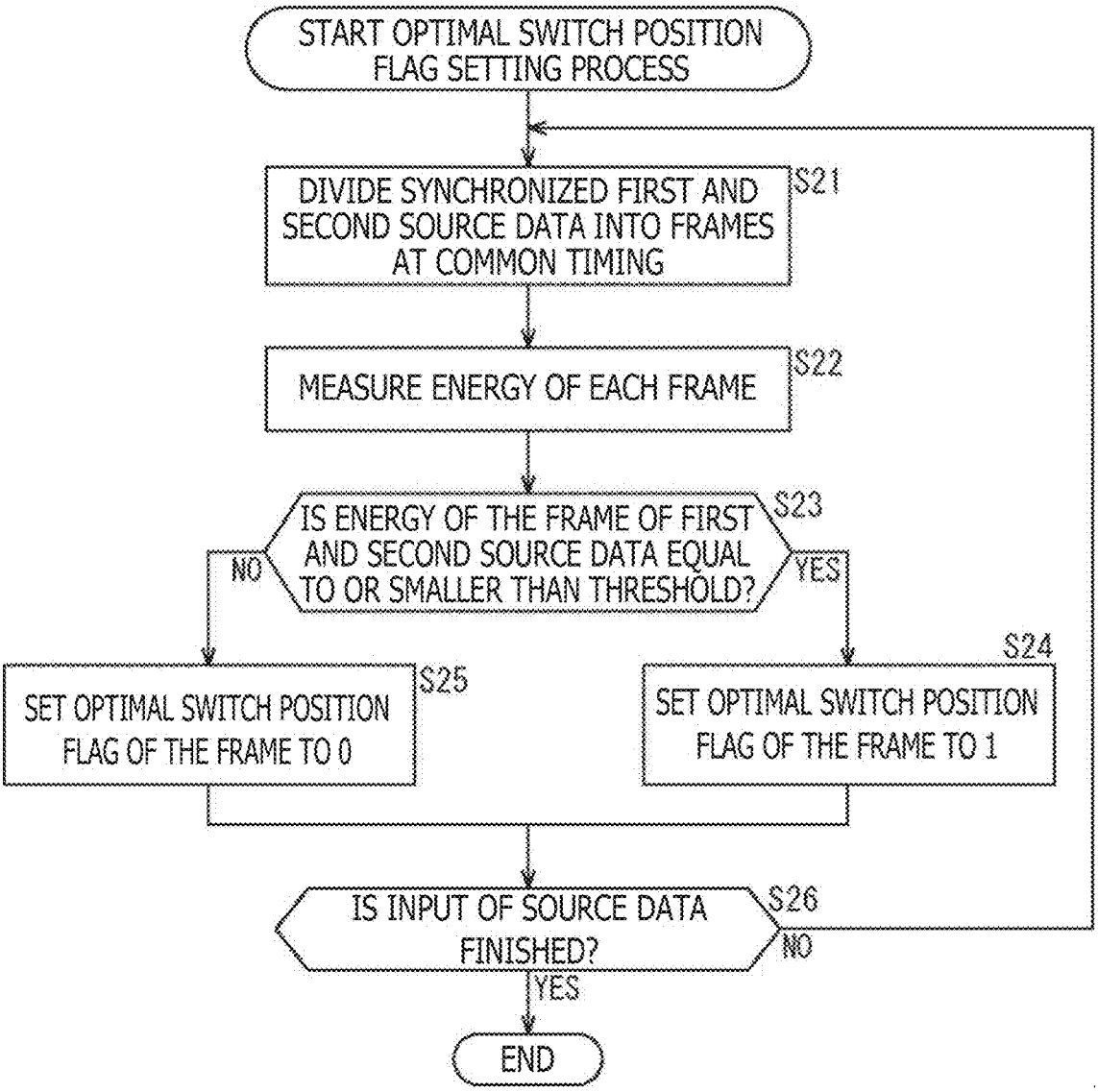
FIG. 7 is a flow chart describing an optimal switch position flag setting process.
Figure 8:
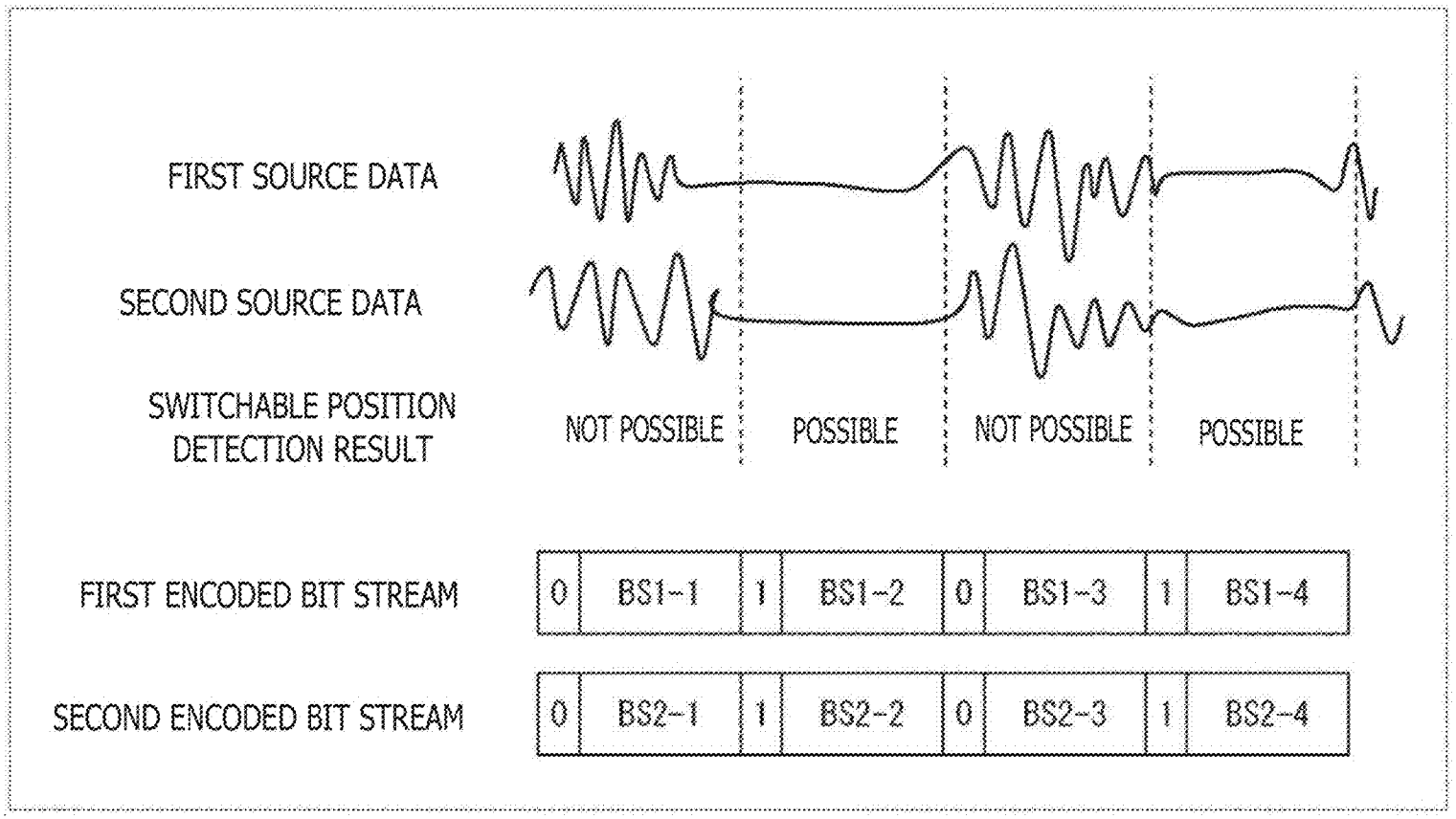
FIG. 8 is a diagram depicting a state of the optimal switch position flag setting process.

FIG. 7 is a flow chart describing the optimal switch position flag setting process executed by the supplier of the content. FIG. 8 depicts a state of the optimal switch position flag setting process.

In step S21, first and second source data input from the earlier stage (sources of the first and second encoded bit streams with synchronized reproduction timing) are divided into frames, and in step S22, the energy in each of the divided frames is measured.

In step S23, whether or not the energy of the first and second source data is equal to or smaller than a predetermined threshold is determined for each frame. If the energy of both of the first and second source data is equal to or smaller than the predetermined threshold, the process proceeds to step S24, and the optimal switch position flag for the frame is set to "1" indicating that the position is the optimal switch position.

On the other hand, if the energy of at least one of the first or second source data is greater than the predetermined threshold, the process proceeds to step S25, and the optimal switch position flag for the frame is set to "0" indicating that the position is not the optimal switch position.

In step S26, whether or not the input of the first and second source data is finished is determined, and if the input of the first and second source data is continuing, the process returns to step S21 to repeat the subsequent process. If the input of the first and second source data is finished, the optimal switch position flag setting process ends.

Figure 9:
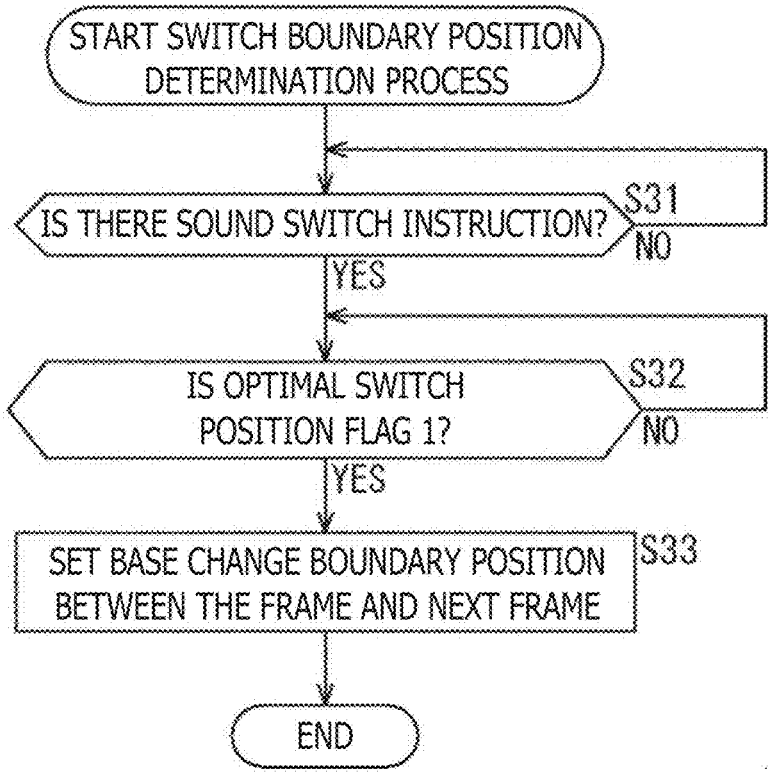
FIG. 9 is a flow chart describing a switch boundary position determination process.
Figure 10:
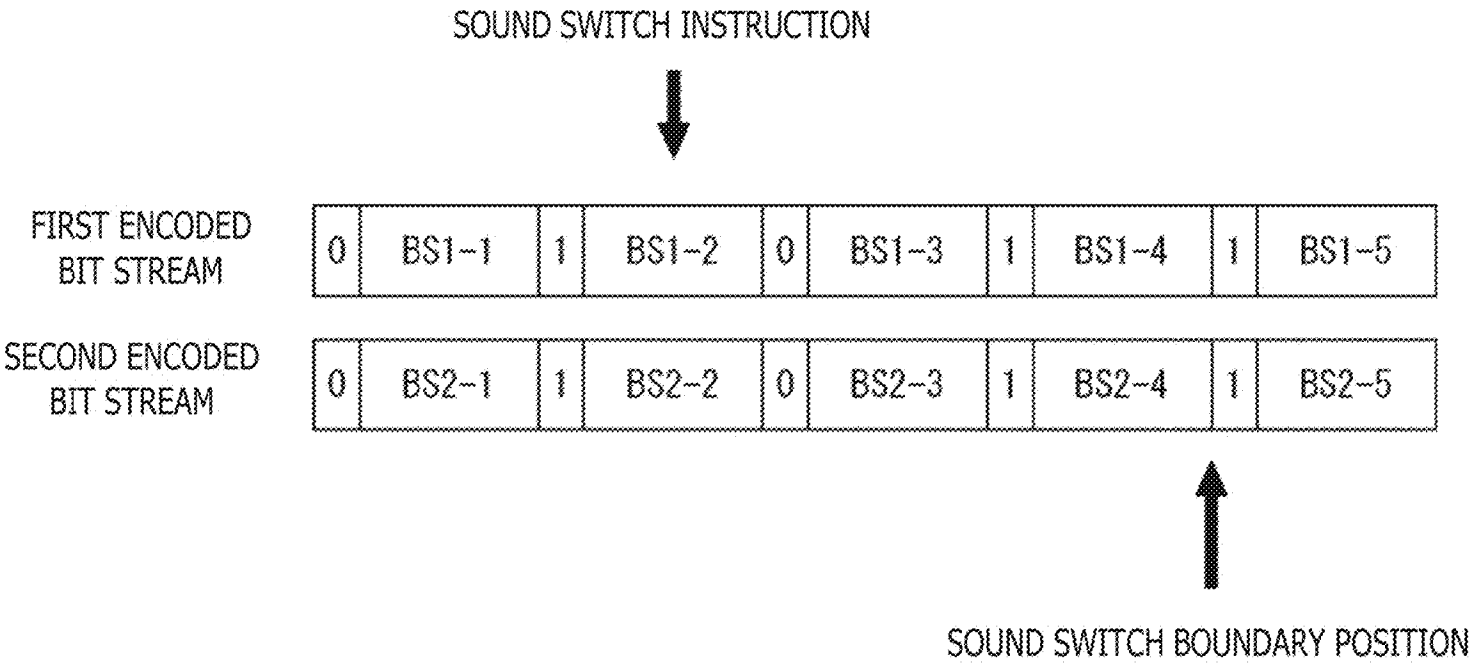
FIG. 10 is a diagram depicting a state of the switch boundary position determination process.

Next, FIG. 9 is a flow chart describing a switch boundary position determination process of sound in the decoding apparatus 30 corresponding to the case in which the optimal switch position flag is set for each frame of the first and second encoded bit streams in the optimal switch position flag setting process. FIG. 10 is a diagram depicting a state of the switch boundary position determination process.

The switch boundary position determination process is executed in place of step S1 and step S2 of the sound switching process described with reference to FIG. 6.

In step S31, the selection unit 33 of the decoding apparatus 30 determines whether or not there is a sound switch instruction from the user and waits until there is a sound switch instruction. While the selection unit 33 waits, the selective output by the selection unit 33 is maintained. Therefore, the decoding apparatus 30 continuously outputs the PCM data based on the first encoded bit stream at a normal volume.

When there is a sound switch instruction from the user, the process proceeds to step S32. In step S32, the selection unit 33 waits until the optimal switch position flag becomes 1, the optimal switch position flag added to each frame of the first and second encoded bit streams (quantization data as decoding results of the first and second encoded bit streams) sequentially input from the earlier stage. While the selection unit 33 waits, the selective output by the selection unit 33 is also maintained. When the optimal switch position flag becomes 1, the process proceeds to step S33, and the selection unit 33 sets the switch boundary position of sound between the frame with the optimal switch position flag of 1 and the next frame. This completes the switch boundary position determination process.

According to the optimal switch position flag setting process and the switch boundary position determination process described above, the position where the sound is as close to silence as possible can be set as the switch boundary position. Therefore, the influence caused by the execution of the fade-out process and the fade-in process can be reduced.

Further, even when the optimal switch position flag is not added, the selection unit 33 or the like in the decoding apparatus 30 may refer to information associated with the gain of the encoded bit streams and detect the position of the volume equal to or smaller than a designated threshold to determine the switch boundary position. For example, information such as a scale factor can be used for the information associated with the gain in an encoding system such as AAC and MP3.

<Second Switching Method of Encoded Bit Stream by Decoding Apparatus 30>

Figure 11:
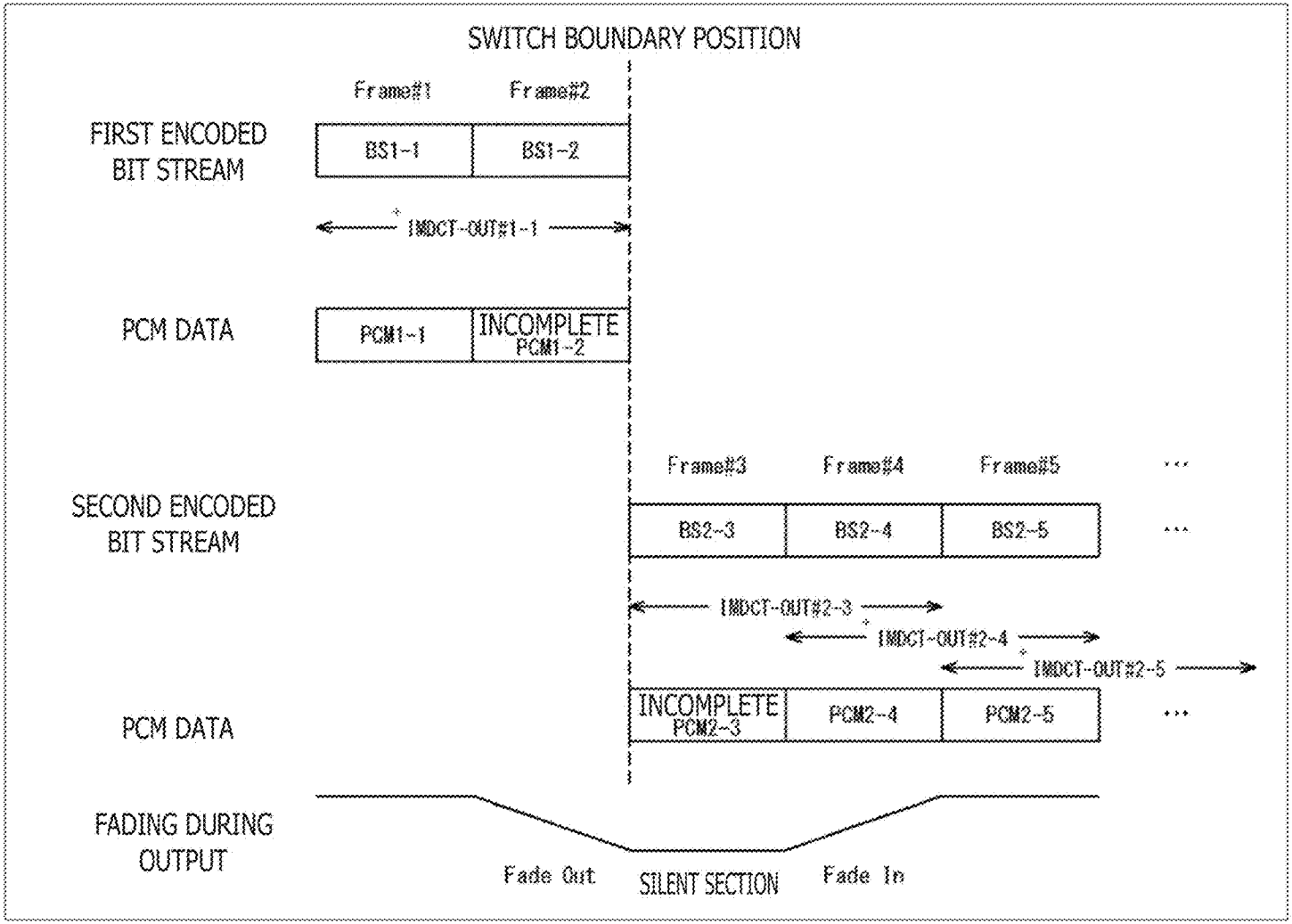
FIG. 11 is a diagram depicting a second switching method of the audio encoded bit stream by the decoding apparatus of FIG. 4.

Next, FIG. 11 depicts a second switching method of the encoded bit stream by the decoding apparatus 30.

As depicted in FIG. 11, when the switch boundary position is set between Frame #2 and Frame #3, and the first encoded bit stream is to be switched to the second encoded bit stream, the IMDCT processing is applied to the data up to Frame #2 just before the switch boundary position for the first encoded bit stream. In this case, although the data up to PCM1-1 corresponding to Frame #1 can be completely reconstructed, the reconstruction of PCM1-2 corresponding to Frame #2 is incomplete.

Meanwhile, for the second encoded bit stream, the IMDCT processing is applied to the data from Frame #3 just after the switch boundary position. In this case, the reconstruction of PCM2-3 corresponding to Frame #3 is incomplete, and the data is completely reconstructed from PCM2-4 corresponding to Frame #4.

Meanwhile, when the PCM data is output, the data up to completely reconstructed PCM1-1 corresponding to Frame #1 is output at a normal volume. The volume of incomplete PCM1-2 corresponding to Frame #2 just before the switch boundary position is gradually reduced by the fade-out process, and the muting process is executed to set a silent section for incomplete PCM2-3 corresponding to Frame #3 just after the switch boundary position. Further, the volume of completely reconstructed PCM2-4 is gradually increased by the fade-in process, and the data is output at a normal volume from PCM2-5 corresponding to Frame #5.

In this way, the incompletely reconstructed PCM data is output just after the change boundary position, and there is no need to execute two decoding processes in parallel. Furthermore, the fade-out process, the muting process, and the fade-in process connect the incomplete PCM data, and this can reduce the volume of harsh glitch noise caused by discontinuity of frames due to the switch of sound.

<Third Switching Method of Encoded Bit Stream by Decoding Apparatus 30>

Figure 12:
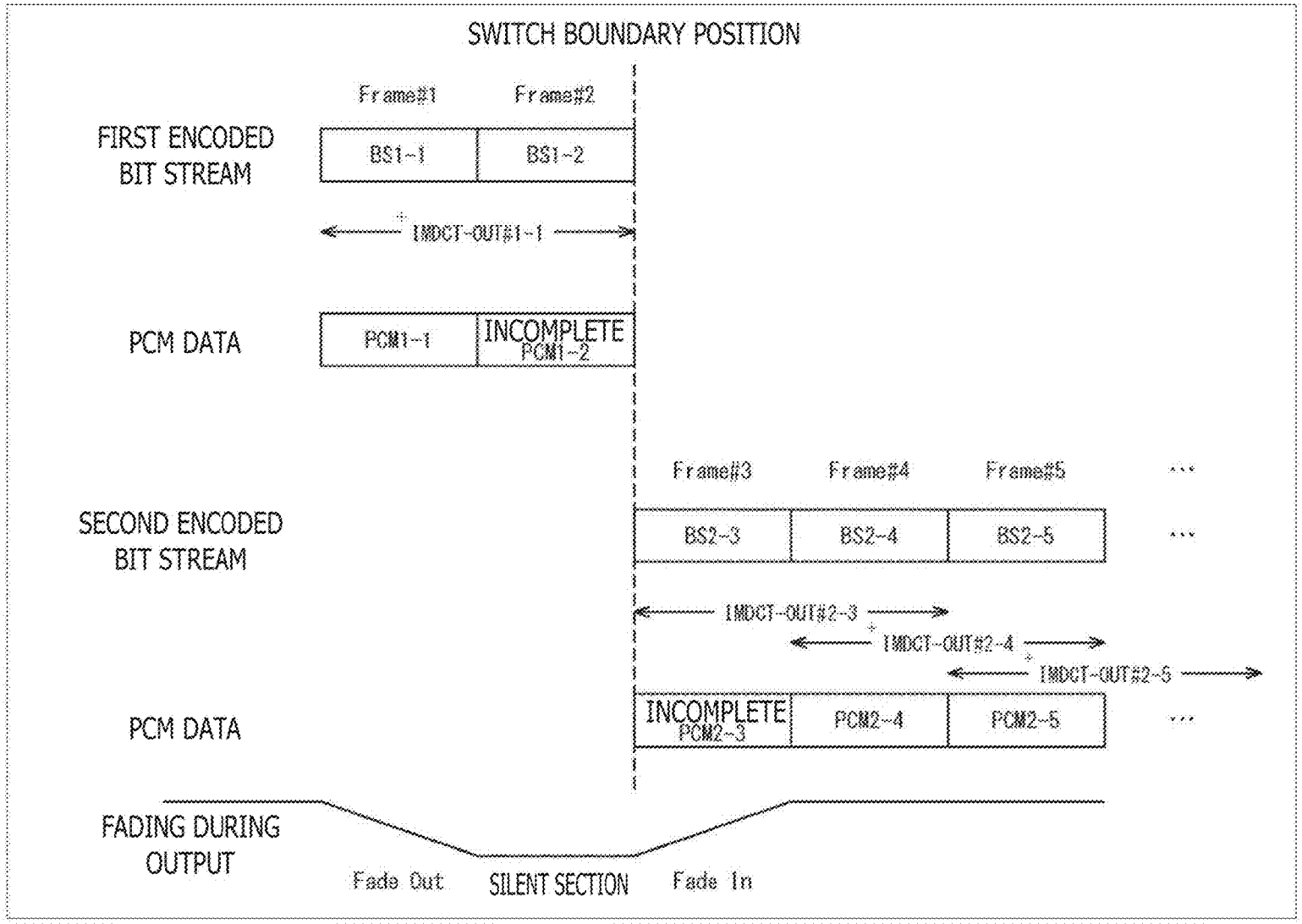
FIG. 12 is a diagram depicting a third switching method of the audio encoded bit stream by the decoding apparatus of FIG. 4.

Next, FIG. 12 depicts a third switching method of the encoded bit stream by the decoding apparatus 30.

As depicted in FIG. 12, when the switch boundary position is set between Frame #2 and Frame #3, and the first encoded bit stream is to be switched to the second encoded bit stream, the IMDCT processing is applied to the data up to Frame #2 just before the switch boundary position for the first encoded bit stream. In this case, although the data up to PCM1-1 corresponding to Frame #1 can be completely reconstructed, the reconstruction of PCM1-2 corresponding to Frame #2 is incomplete.

Meanwhile, for the second encoded bit stream, the IMDCT processing is applied to the data from Frame #3 just after the switch boundary position. In this case, the reconstruction of PCM2-3 corresponding to Frame #3 is incomplete, and the data is completely reconstructed from PCM2-4 corresponding to Frame #4.

Meanwhile, when the PCM data is output, the data before PCM1-1 corresponding to Frame #1 is output at a normal volume, and the volume of PCM1-1 is gradually reduced by the fade-out process. The muting process is executed to set a silent section for incomplete PCM1-2 corresponding to Frame #2 just before the switch boundary position. Further, the volume of incomplete PCM2-3 corresponding to Frame #3 just after the switch boundary position is gradually increased by the fade-in process, and the data is output at a normal volume from PCM2-4 corresponding to Frame #4.

In this way, the incompletely reconstructed PCM data is output just after the change boundary position, and there is no need to execute two decoding processes in parallel. Furthermore, the fade-out process, the muting process, and the fade-in process connect the incomplete PCM data, and this can reduce the volume of harsh glitch noise caused by discontinuity of frames due to the switch of sound.

<Application Example of Present Disclosure>

Other than the application for switching the first and second encoded bit streams with synchronized reproduction timing, the present disclosure can also be applied, for example, to switch objects in 3D Audio coding. More specifically, when grouped object data is to be switched to another group (Switch Group) all together, the present disclosure can be applied to switch a plurality of objects all at once in order to switch the viewpoint in a reproduction scene or a free-viewpoint video.

The present disclosure can also be applied to switch the channel environment from 2 ch stereo sound to surround sound of 5.1 ch or the like or to switch surround-based streams according to changes of respective seats in a free-viewpoint video.

Incidentally, the series of processes by the decoding apparatus 30 can be executed by hardware or can be executed by software. When the series processes are executed by software, a program constituting the software is installed on a computer. Here, examples of the computer include a computer incorporated into dedicated hardware and a general-purpose personal computer, for example, that can execute various functions by installing various programs.

Figure 13:
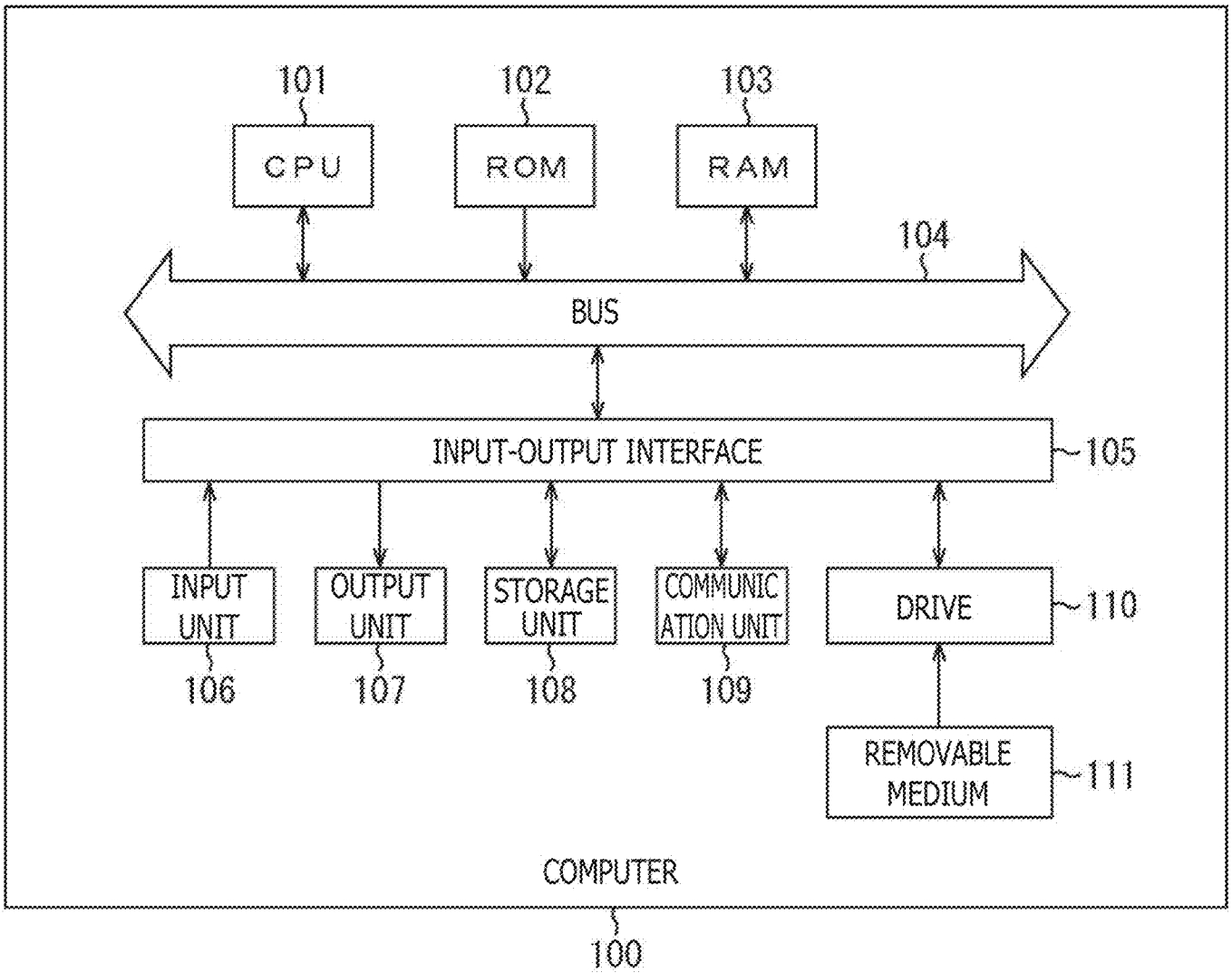
FIG. 13 is a block diagram depicting a configuration example of a general-purpose computer.

FIG. 13 is a block diagram depicting a configuration example of hardware of a computer that uses a program to execute the series of processes.

In a computer 100, a CPU (Central Processing Unit) 101, a ROM (Read Only Memory) 102, and a RAM (Random Access Memory) 103 are connected to each other by a bus 104.

An input-output interface 105 is further connected to the bus 104. An input unit 106, an output unit 107, a storage unit 108, a communication unit 109, and a drive 110 are connected to the input-output interface 105.

The input unit 106 includes a keyboard, a mouse, a microphone, and the like. The output unit 107 includes a display, a speaker, and the like. The storage unit 108 includes a hard disk, a non-volatile memory, and the like. The communication unit 109 includes a network interface and the like. The drive 110 drives a removable medium 111, such as a magnetic disk, an optical disk, a magneto-optical disk, and a semiconductor memory.

In the computer 100 configured in this way, the CPU 101 loads, on the RAM 103, a program stored in the storage unit 108 through the input-output interface 105 and the bus 104 and executes the program to execute the series of processes, for example.

Note that the program executed by the computer 100 may be a program for executing the processes in chronological order described in the present specification or may be a program for executing the processes in parallel or at a necessary timing such as when the program is invoked.

The embodiment of the present disclosure is not limited to the embodiment described above, and various changes can be made without departing from the scope of the present disclosure.

The present disclosure can also be configured as follows.

(1)

A decoding apparatus including:

an acquisition unit that acquires a plurality of audio encoded bit streams in which a plurality of pieces of source data with synchronized reproduction timing are each encoded on the basis of frames after MDCT processing;

a selection unit that determines a boundary position for switching output of the plurality of audio encoded bit streams and that selectively supplies one of the plurality of acquired audio encoded bit streams to a decoding processing unit according to the boundary position; and the decoding processing unit that applies a decoding process including IMDCT processing corresponding to the MDCT processing to one of the plurality of audio encoded bit streams input through the selection unit, in which the decoding processing unit skips overlap-and-add in the IMDCT processing corresponding to each frame before and after the boundary position.

(2)

The decoding apparatus according (1), further including:

a fading processing unit that applies fading processing to decoding processing results of the frames before and after the boundary position in which the overlap-and-add by the decoding processing unit is skipped.

(3)

The decoding apparatus according to (2), in which the fading processing unit applies a fade-out process to the decoding processing result of the frame before the boundary position and applies a fade-in process to the decoding processing result of the frame after the boundary position in which the overlap-and-add by the decoding processing unit is skipped.

(4)

The decoding apparatus according to (2), in which the fading processing unit applies a fade-out process to the decoding processing result of the frame before the boundary position and applies a muting process to the decoding processing result of the frame after the boundary position in which the overlap-and-add by the decoding processing unit is skipped.

(5)

The decoding apparatus according to (2), in which the fading processing unit applies a muting process to the decoding processing result of the frame before the boundary position and applies a fade-in process to the decoding processing result of the frame after the boundary position in which the overlap-and-add by the decoding processing unit is skipped.

(6)

The decoding apparatus according to any one of (1) to (5), in which the selection unit determines the boundary position on the basis of an optimal switch position flag that is added to each frame and that is set by a supplier of the plurality of audio encoded bit streams.

(7)

The decoding apparatus according to (6), in which the optimal switch position flag is set by the supplier of the audio encoded bit streams on the basis of energy or context of the source data.

(8)

The decoding apparatus according to any one of (1) to (5), in which the selection unit determines the boundary position on the basis of information associated with gain of the plurality of audio encoded bit streams.

(9)

A decoding method executed by a decoding apparatus, the decoding method including:

an acquisition step of acquiring a plurality of audio encoded bit streams in which a plurality of pieces of source data with synchronized reproduction timing are each encoded on the basis of frames after MDCT processing;

a determination step of determining a boundary position for switching output of the plurality of audio encoded bit streams;

a selection step of selectively supplying one of the plurality of acquired audio encoded bit streams to a decoding processing step according to the boundary position; and the decoding processing step of applying a decoding process including IMDCT processing corresponding to the MDCT processing to one of the plurality of audio encoded bit streams supplied selectively, in which in the decoding processing step, overlap-and-add in the IMDCT processing corresponding to each frame before and after the boundary position is skipped.

(10)

A program causing a computer to function as:

an acquisition unit that acquires a plurality of audio encoded bit streams in which a plurality of pieces of source data with synchronized reproduction timing are encoded on the basis of frames after MDCT processing;

a selection unit that determines a boundary position for switching output of the plurality of audio encoded bit streams and that selectively supplies one of the plurality of acquired audio encoded bit streams to a decoding processing unit according to the boundary position; and the decoding processing unit that applies a decoding process including IMDCT processing corresponding to the MDCT processing to one of the plurality of audio encoded bit streams input through the selection unit, in which the decoding processing unit skips overlap-and-add in the IMDCT processing corresponding to each frame before and after the boundary position.

REFERENCE SIGNS LIST

30 Decoding apparatus, 31 Demultiplexing unit, 32-1, 32-2 Decoding units, 33 Selection unit, 34 Decoding processing unit, 35 Inverse quantization unit, 36 IMDCT unit, 37 Fading processing unit, 100 Computer, 101 CPU

The invention claimed is:

1. A decoding apparatus comprising:

an acquisition software-implemented unit that acquires a plurality of audio encoded bit streams in which a plurality of pieces of source data with synchronized reproduction timing are each encoded on the basis of frames after MDCT processing;

a selection software-implemented unit that determines a boundary position for switching output of the plurality of audio encoded bit streams and that selectively supplies one of the plurality of acquired audio encoded bit streams to a decoding processing unit according to the boundary position; and the decoding processing software-implemented unit that applies a decoding process including IMDCT processing corresponding to the MDCT processing to one of the plurality of audio encoded bit streams input through the selection unit, wherein the decoding processing software-implemented unit skips overlap-and-add in the IMDCT processing corresponding to each frame before and after the boundary position; and a fading processing software-implemented unit that applies fading processing to decoding processing results of the frames before and after the boundary position in which the overlap-and-add by the decoding processing unit is skipped.

2. The decoding apparatus according to claim 1, wherein the fading processing software-implemented unit applies a fade-out process to the decoding processing result of the frame before the boundary position and applies a fade-in process to the decoding processing result of the frame after the boundary position in which the overlap-and-add by the decoding processing unit is skipped.

3. The decoding apparatus according to claim 1, wherein the fading processing software-implemented unit applies a fade-out process to the decoding processing result of the frame before the boundary position and applies a muting process to the decoding processing result of the frame after the boundary position in which the overlap-and-add by the decoding processing unit is skipped.

4. The decoding apparatus according to claim 1, wherein the fading software-implemented processing unit applies a muting process to the decoding processing result of the frame before the boundary position and applies a fade-in process to the decoding processing result of the frame after the boundary position in which the overlap-and-add by the decoding processing unit is skipped.

5. The decoding apparatus according to claim 1, wherein the selection software-implemented unit determines the boundary position on the basis of an optimal switch position flag that is added to each frame and that is set by a supplier of the plurality of audio encoded bit streams.

6. The decoding apparatus according to claim 5, wherein the optimal switch position flag is set by the supplier of the audio encoded bit streams on the basis of energy or context of the source data.

7. The decoding apparatus according to claim 1, wherein the selection software-implemented unit determines the boundary position on the basis of information associated with gain of the plurality of audio encoded bit streams.

8. A decoding method executed by a decoding apparatus, the decoding method comprising:

an acquisition step of acquiring a plurality of audio encoded bit streams in which a plurality of pieces of source data with synchronized reproduction timing are each encoded on the basis of frames after MDCT processing;

a determination step of determining a boundary position for switching output of the plurality of audio encoded bit streams;

a selection step of selectively supplying one of the plurality of acquired audio encoded bit streams to a decoding processing step according to the boundary position; and the decoding processing step of applying a decoding process including IMDCT processing corresponding to the MDCT processing to one of the plurality of audio encoded bit streams supplied selectively, wherein in the decoding processing step, overlap-and-add in the IMDCT processing corresponding to each frame before and after the boundary position is skipped, and a fading processing step that applies fading processing to decoding processing results of the frames before and after the boundary position in which the overlap-and-add by the decoding processing unit is skipped.

9. A non-transitory computer readable storage medium having computer readable instructions stored thereon, that when executed by a processor, cause the processor to function as:

an acquisition unit that acquires a plurality of audio encoded bit streams in which a plurality of pieces of source data with synchronized reproduction timing are encoded on the basis of frames after MDCT processing;

a selection unit that determines a boundary position for switching output of the plurality of audio encoded bit streams and that selectively supplies one of the plurality of acquired audio encoded bit streams to a decoding processing unit according to the boundary position; and the decoding processing unit that applies a decoding process including IMDCT processing corresponding to the MDCT processing to one of the plurality of audio encoded bit streams input through the selection unit, wherein the decoding processing unit skips overlap-and-add in the IMDCT processing corresponding to each frame before and after the boundary position, and a fading processing unit that applies fading processing to decoding processing results of the frames before and after the boundary position in which the overlap-and-add by the decoding processing unit is skipped.

10. The decoding method according to claim 8, wherein the fading processing step applies a fade-out process to the decoding processing result of the frame before the boundary position and applies a fade-in process to the decoding processing result of the frame after the boundary position in which the overlap-and-add by the decoding processing unit is skipped.

11. The decoding method according to claim 8, wherein the fading processing step applies a fade-out process to the decoding processing result of the frame before the boundary position and applies a muting process to the decoding processing result of the frame after the boundary position in which the overlap-and-add by the decoding processing unit is skipped.

12. The decoding method according to claim 8, wherein the fading processing step applies a muting process to the decoding processing result of the frame before the boundary position and applies a fade-in process to the decoding processing result of the frame after the boundary position in which the overlap-and-add by the decoding processing unit is skipped.

13. The decoding method according to claim 8, wherein the selection step determines the boundary position on the basis of an optimal switch position flag that is added to each frame and that is set by a supplier of the plurality of audio encoded bit streams.

14. The decoding method according to claim 13, wherein the optimal switch position flag is set by the supplier of the audio encoded bit streams on the basis of energy or context of the source data.

15. The decoding method according to claim 8, wherein the selection step determines the boundary position on the basis of information associated with gain of the plurality of audio encoded bit streams.

* * * * *